US006653931B2

(12) United States Patent
Chiang

(10) Patent No.: US 6,653,931 B2
(45) Date of Patent: Nov. 25, 2003

(54) PICTURE FRAME OR DOORBELL HAVING WARNING FUNCTION

(76) Inventor: Chen-Yie Chiang, No. 163, Hsiang Ho 3 St., Chia Li Chen, Tainan (TW)

( * ) Notice: Subject to any disclaimer, the term of this patent is extended or adjusted under 35 U.S.C. 154(b) by 7 days.

(21) Appl. No.: 10/132,852

(22) Filed: Apr. 23, 2002

(65) Prior Publication Data

US 2003/0197623 A1 Oct. 23, 2003

(51) Int. Cl.[7] ..... G08B 1/00

(52) U.S. Cl. ..... 340/286.05; 340/692; 340/693.5; 40/700

(58) Field of Search ..... 340/286.05, 693.11, 340/628, 693.9, 539.1, 693.5, 692, 693.6; 40/700, 717

(56) References Cited

U.S. PATENT DOCUMENTS 3,857,191 A * 12/1974 Sadorus ..... 40/455
4,611,200 A * 9/1986 Stilwell ..... 340/628
4,748,756 A * 6/1988 Ross ..... 40/715
5,045,327 A * 9/1991 Tarlow et al. ..... 704/270
5,182,872 A * 2/1993 Lee et al. ..... 40/717
5,359,374 A * 10/1994 Schwartz ..... 40/455
5,504,836 A * 4/1996 Loudermilk ..... 704/272
5,819,458 A * 10/1998 Hadden ..... 40/782

* cited by examiner

*Primary Examiner*—Daniel J. Wu
*Assistant Examiner*—Phung Nguyen
(74) *Attorney, Agent, or Firm*—Pro-Techtor International Services

(57) ABSTRACT

A picture frame or a doorbell having warning function includes a main body consisting of a front housing, a rear housing and a transparent plate for placing photos or pictures. The main body is provided with a sensor hole, a speaker, an electronic control circuit and/or an emission circuit to deliver signals to a receive circuit of a subsidiary device positioned at any location in a house (in different rooms or on different stories). When the sensor of the main electronic control circuit senses any unusual light sources, the speaker of the main device can send out warning sounds, and the signals will be delivered to the receive circuit of the subsidiary device through the emission circuit to let the speaker of the subsidiary device give out warning sounds at the same time.

3 Claims, 14 Drawing Sheets

PICTURE FRAME OR DOORBELL HAVING WARNING FUNCTION

BACKGROUND OF THE INVENTION

This invention relates to a picture frame or a doorbell having warning function, particularly to one provided with a fire warning device and an anti-burglary device, capable of sending out warning signals or sounds in advance so as to enable a user take precautions against a fire or a burglar in time.

It is commonly known that a little fire burns up a great deal of corn so warning a fire and taking action in time becomes extremely important to lessen damage caused by a fire. In recent years, a variety of products for warning a fire has been developed and employed. For instance, a sensor (AO), as shown in FIG. 1, fixed on a ceiling (A) functions to sense smoke and immediately give out warning of a fire by spraying liquid or sending out warning sounds.

A picture frame, a clock or a calendar either hung on a wall or placed on a desk generally functions as a decoration for beautifying a room. As shown in FIG. 2, the frame body (B) of the picture frame has a photograph fitted inside, and both the photograph (BO) and the frame body (B) are held by a support board (B1) to stand on a desk with the help of a support rod B2.

FIG. 3 shows a common doorbell sold on the market. The doorbell includes a main body (C) provided with a through opening (C0) for sounds to pass through and also a hang hole (C1) for hanging the doorbell on a wall.

A picture frame or a doorbell extensively used in our daily life should not simply be used as a decoration but can be attached to a clock, a calendar or the like, and further provided with a fire warning device and an anti-burglary device to let a user take precautions against fire or theft in time so as to safeguard one's life and property.

SUMMARY OF THE INVENTION

The objective of this invention is to offer a picture frame or a doorbell combined with a clock or a calendar, and also provided with a fire warning device or an anti-burglary device.

The invention has features described below.

1. The picture frame in this invention includes a main body and a base, and their combination can be freely altered according to practical needs.
2. The main body of the picture frame is provided with an electronic control board having a main control circuit with a sensor for detecting various light sources produced by alteration of the environment, or sensing bodily temperature or smoke and giving out warning sounds, letting the picture frame or the doorbell have multi-functions in use.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
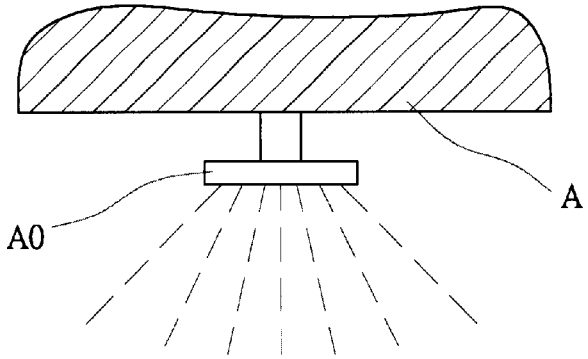
FIG 1 (PRIOR ART)
FIG. 1 is a front view of a conventional alarm.
Figure 2:
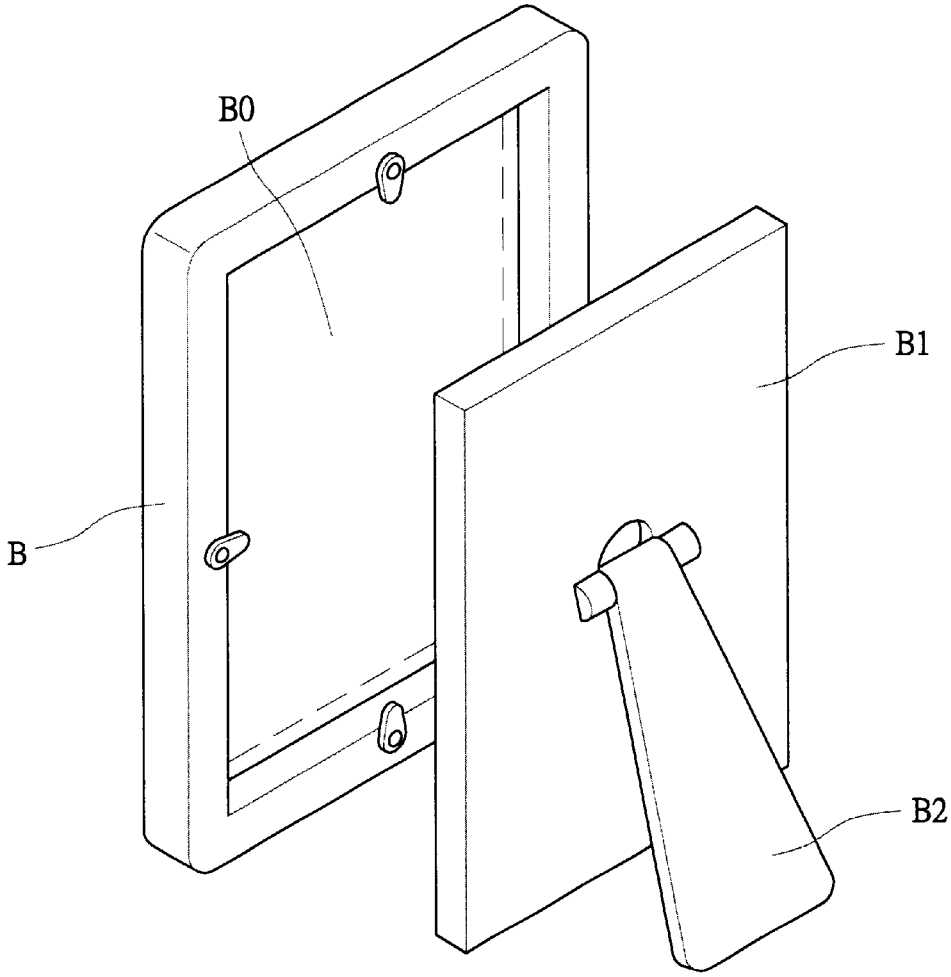
FIG 2 (PRIOR ART)
FIG. 2 is a perspective view of a conventional picture frame.
Figure 3:
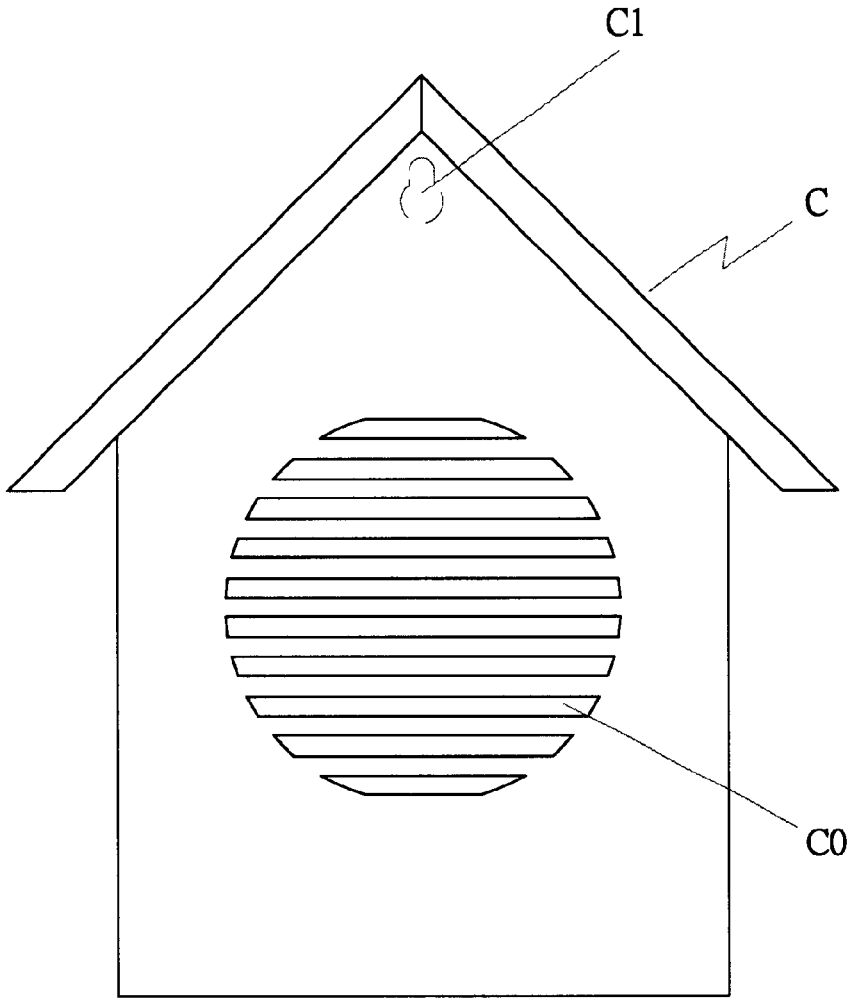
FIG 3 (PRIOR ART)
FIG. 3 is a front view of a conventional doorbell.
Figure 4:
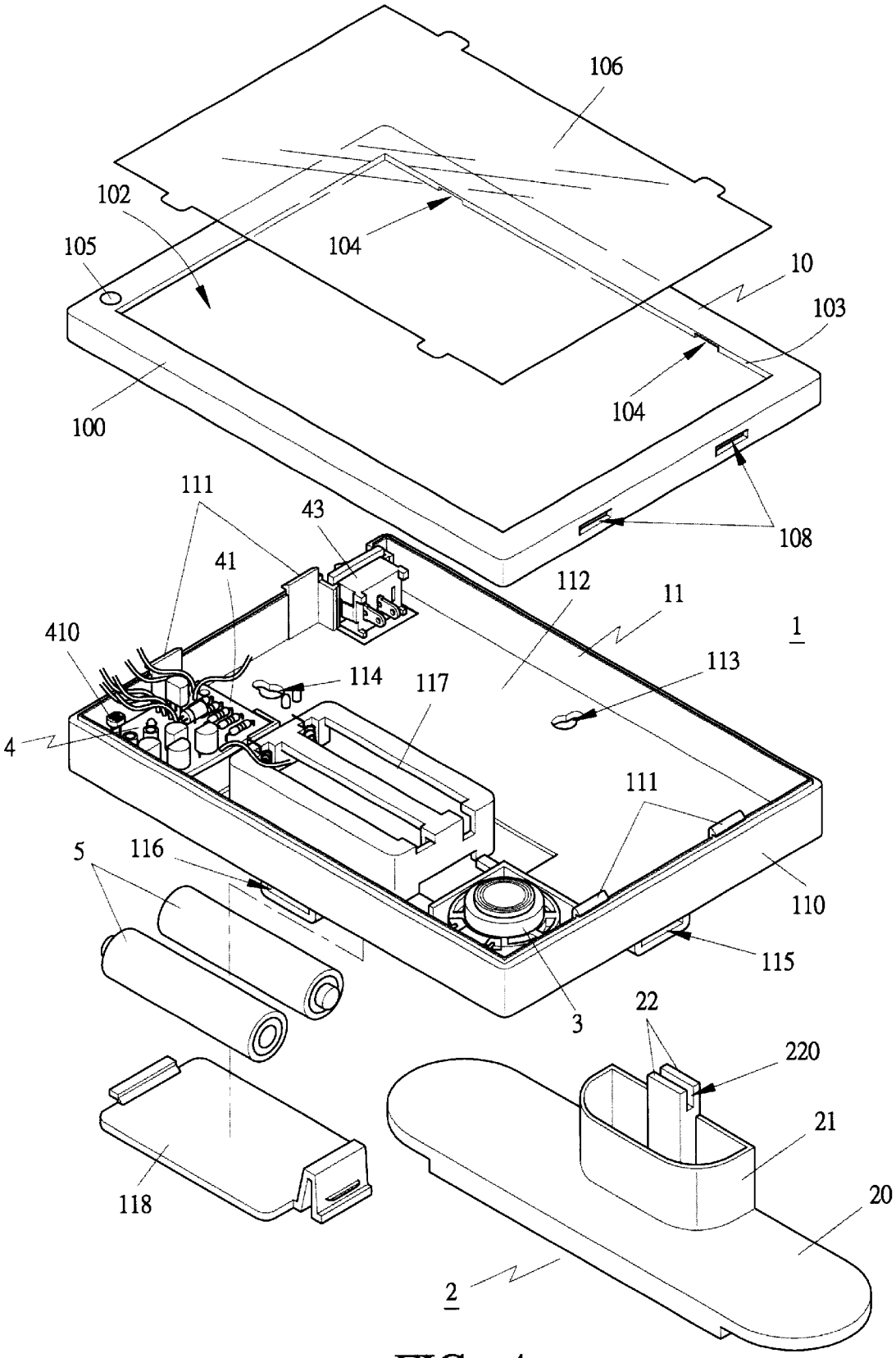
FIG. 4 is an exploded perspective view of a first embodiment of a picture frame in the present invention.

A first and a second preferred embodiments of a picture frame or a doorbell having warning function in the present invention, as shown in FIGS. 4 to 10 and 11, 12, includes respectively a main body 1 and a base 2 combined together.

The main body is composed of a front housing 10 and a rear housing 11. The front housing 10 is provided with a housing body 100 formed with a recess 102 defined with a circumferential wall 103 having insert slots 104 and a sensor receive hole 105. A transparent plate 106 for placing photos or pictures is movably fitted in the insert slots 104. Besides, the front housing 10 has its opposite sides respectively bored with two mortises 108 for respectively receiving tenons 111 of the rear housing 11.

Figure 9:
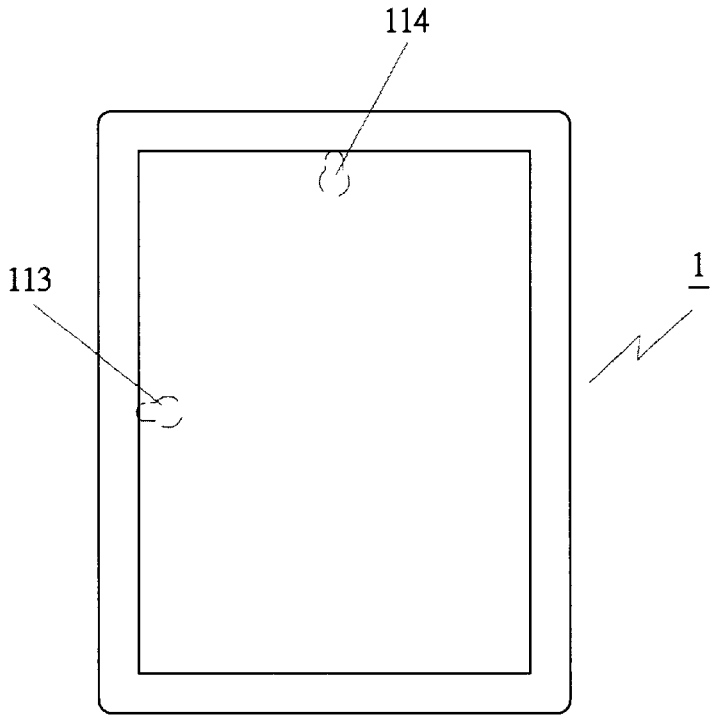
FIG. 9 is a front view of the first embodiment of a picture frame hung on a wall in the present invention.
Figure 10:
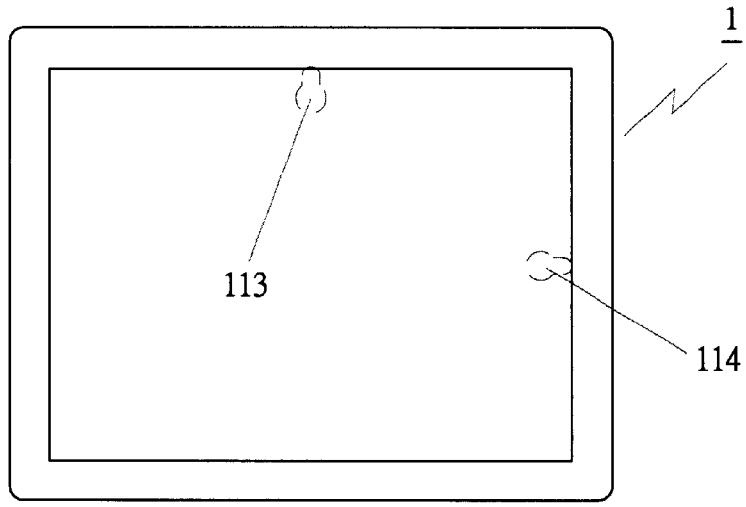
FIG. 10 is another front view of the first embodiment of a picture frame hung on a wall in the present invention.
Figure 11:
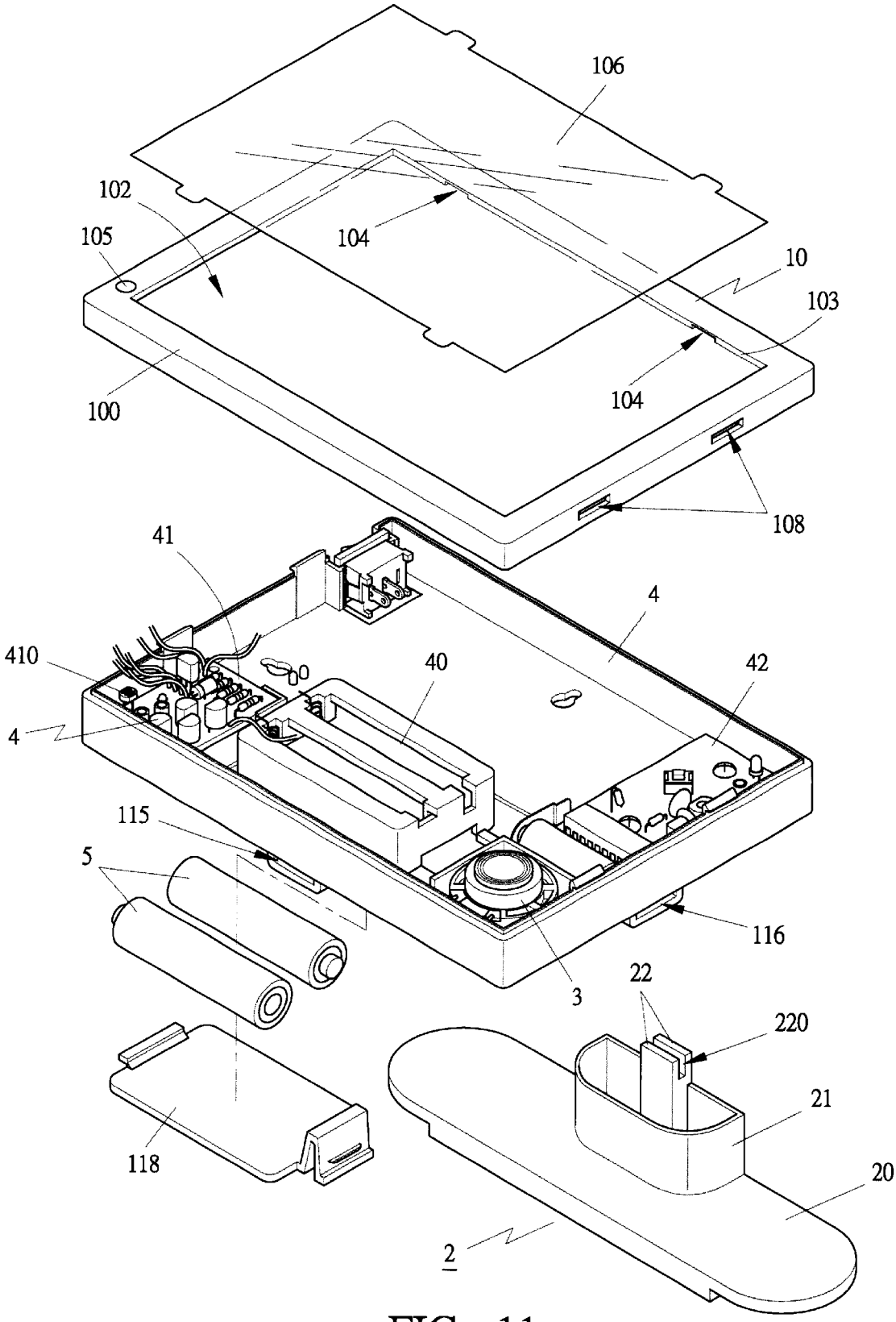
FIG. 11 is an exploded perspective view of a second embodiment of a picture frame in the present invention.

The rear housing 11 has its opposite circumferential sidewalls 110 respectively formed integral with two upward projections 111 for engaging the mortises 108 of the front housing 10 for combining two housings 10, 11 together. A bottom plate 112 of the rear housing is bored with two hang holes 113, 114 for hanging the doorbell or the picture frame on a wall without the base 2, as shown in FIGS. 9 and 10. The rear housing 11 has a lateral side and a one lengthwise side respectively provided with a combining slot 115, 116 for combining with the base 2. Further the rear housing 11 is provided with a speaker 3 and an electronic control board 4 for sending out pleasant sounds when a main control circuit receives any unusual signals or when the doorbell rings. The rear housing 11 is further provided with a battery case 117 for receiving batteries 5 which is covered up by a battery cover 118.

Figure 6:
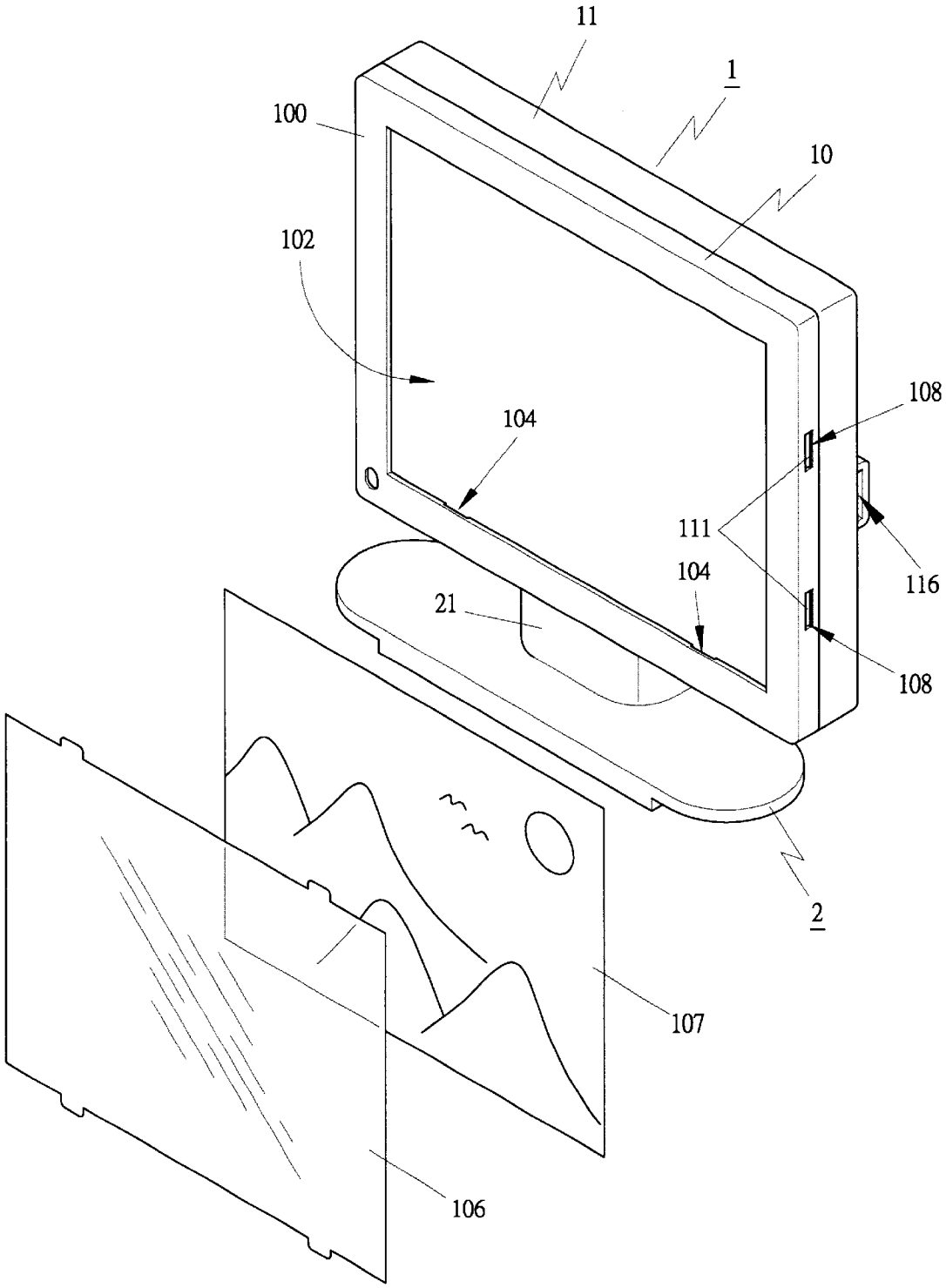
FIG. 6 is a partially exploded perspective view of the first embodiment of a picture frame in the present invention.
Figure 7:
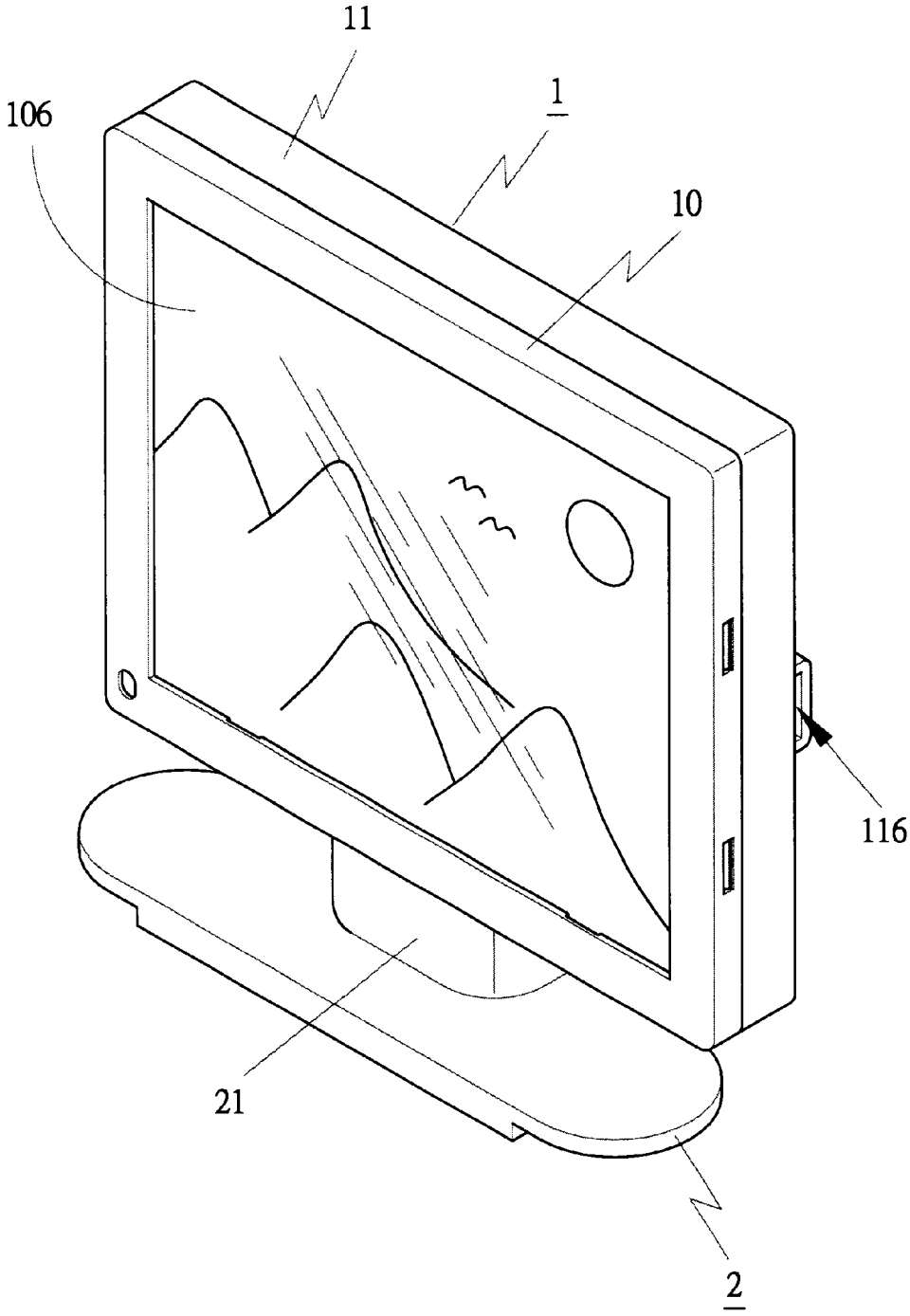
FIG. 7 is a perspective view of the first embodiment of a picture frame in the present invention.
Figure 8:
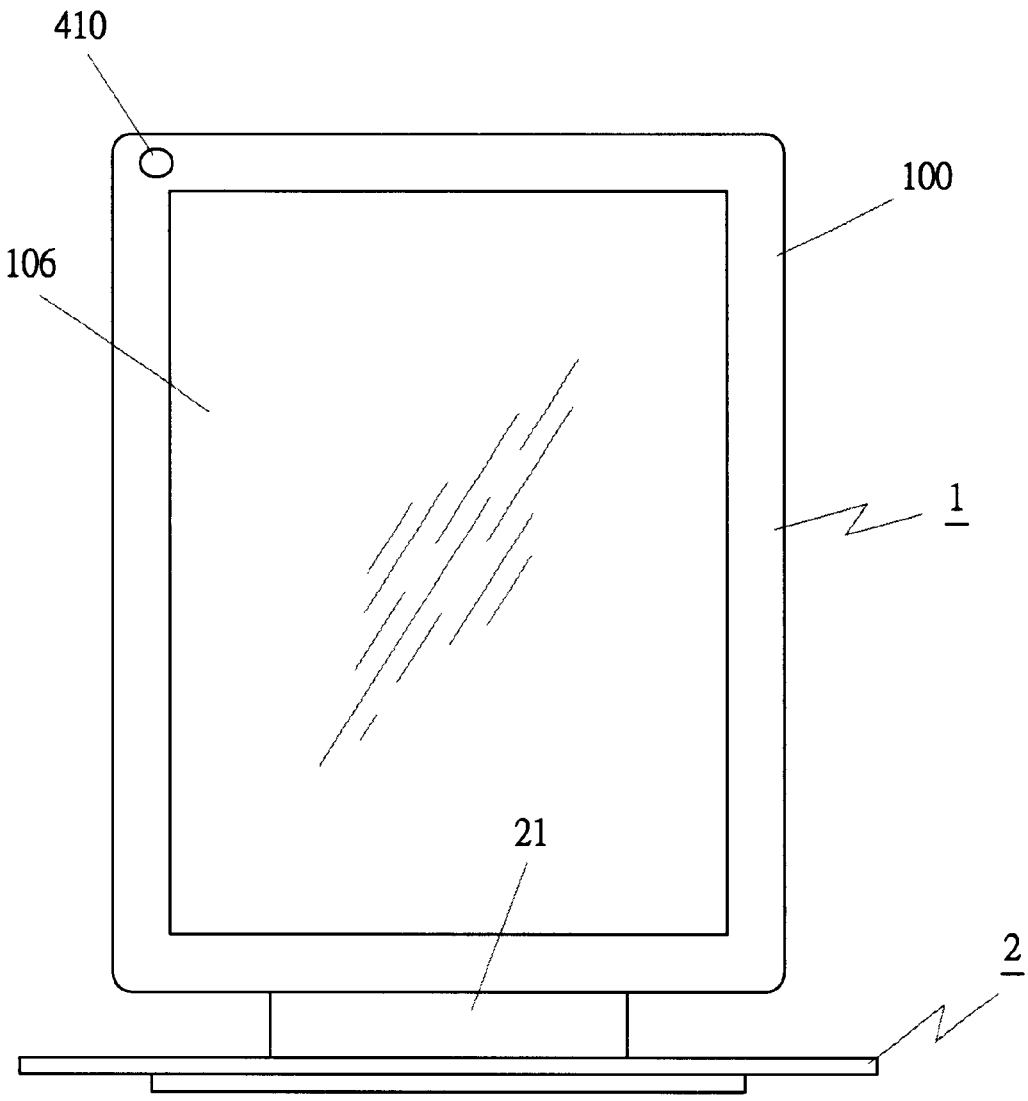
FIG. 8 is a front view of the first embodiment of a picture frame in the present invention.

The base 2 has a flat member 20 for the picture frame or the doorbell to stand on something, and a circumferential wall 21 standing upright on the flat member 20 to rest against the bottom side of the main body 1, as shown in FIGS. 6, 7 and 8. Further, an engage base 22 is fixed at a rear portion of the base 2, having a center slot 220 for engaging the combining slot 115 or 116 of the rear housing 11 to stably combine the main body 1 with the base 2 together.

Figure 5:
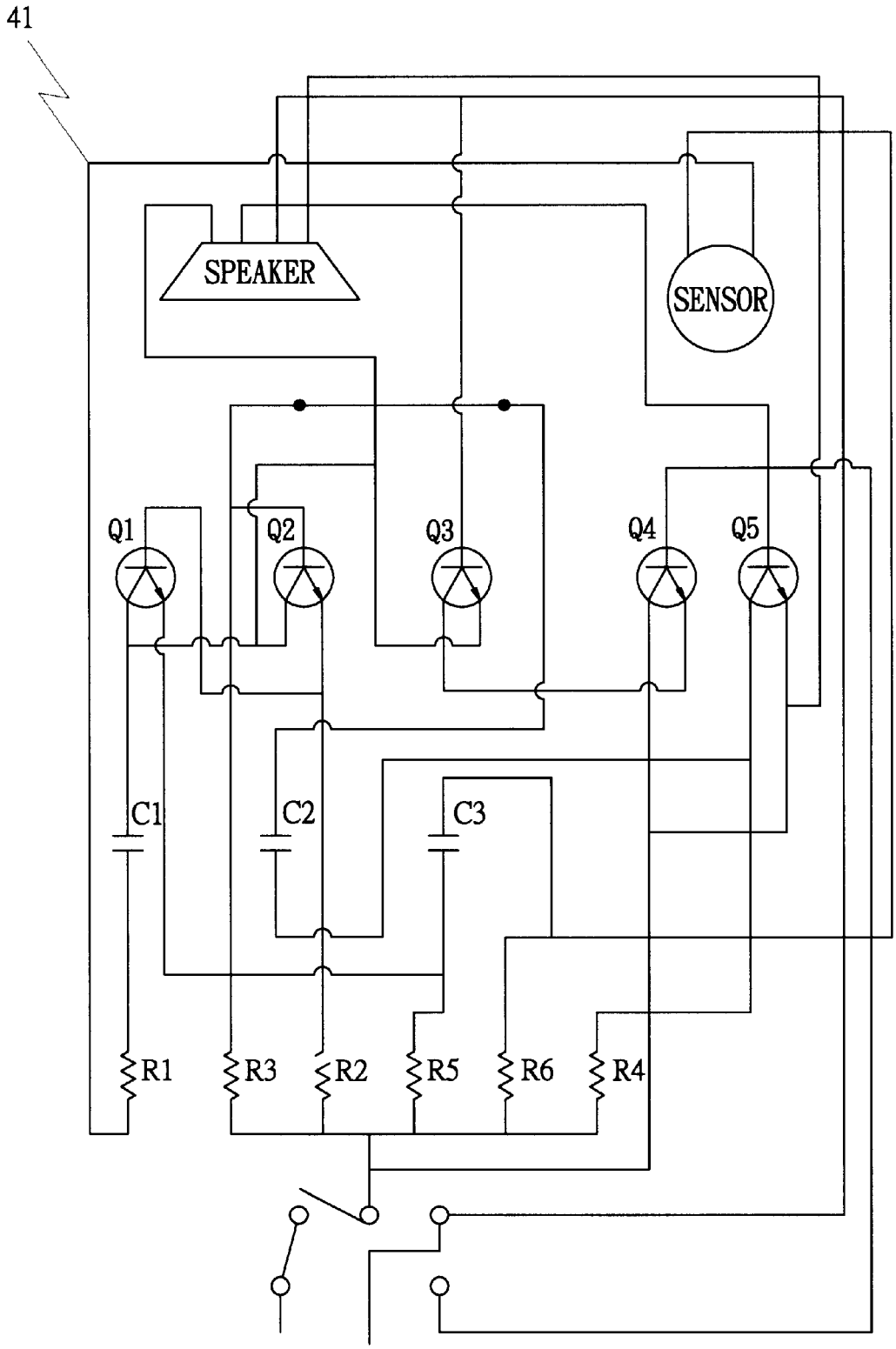
FIG. 5 is a diagram of an electronic control circuit in the first embodiment a picture frame in the present invention.
Figure 12:
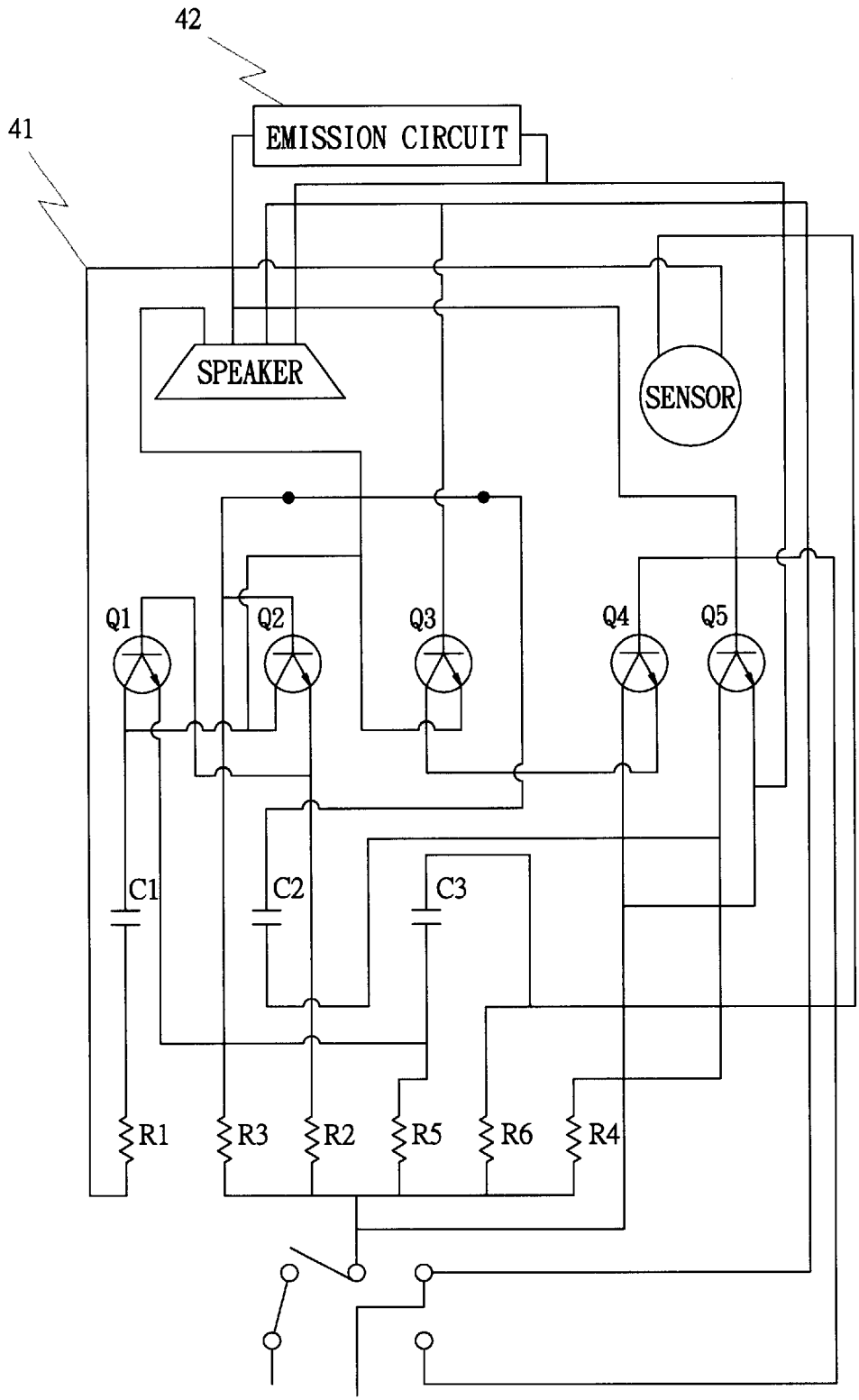
FIG. 12 is a diagram of a control circuit in the second embodiment of a picture frame in the present invention.

The electronic control board 4 has a main control circuit 41 arranged thereon, as shown in FIG. 5 and/or an emission circuit 42, as shown in FIG. 12. The main control circuit 41 is provided with a sensor 410 for receiving unusual signals. The sensor 410 can be a light source detector, a smoke detector or a bodily temperature detector, controlled by a switch 43 installed on one side of the main body 1. The emission circuit 42 can use ultra-red ray or other RF (radio frequency) for emitting signals.

Figure 13:
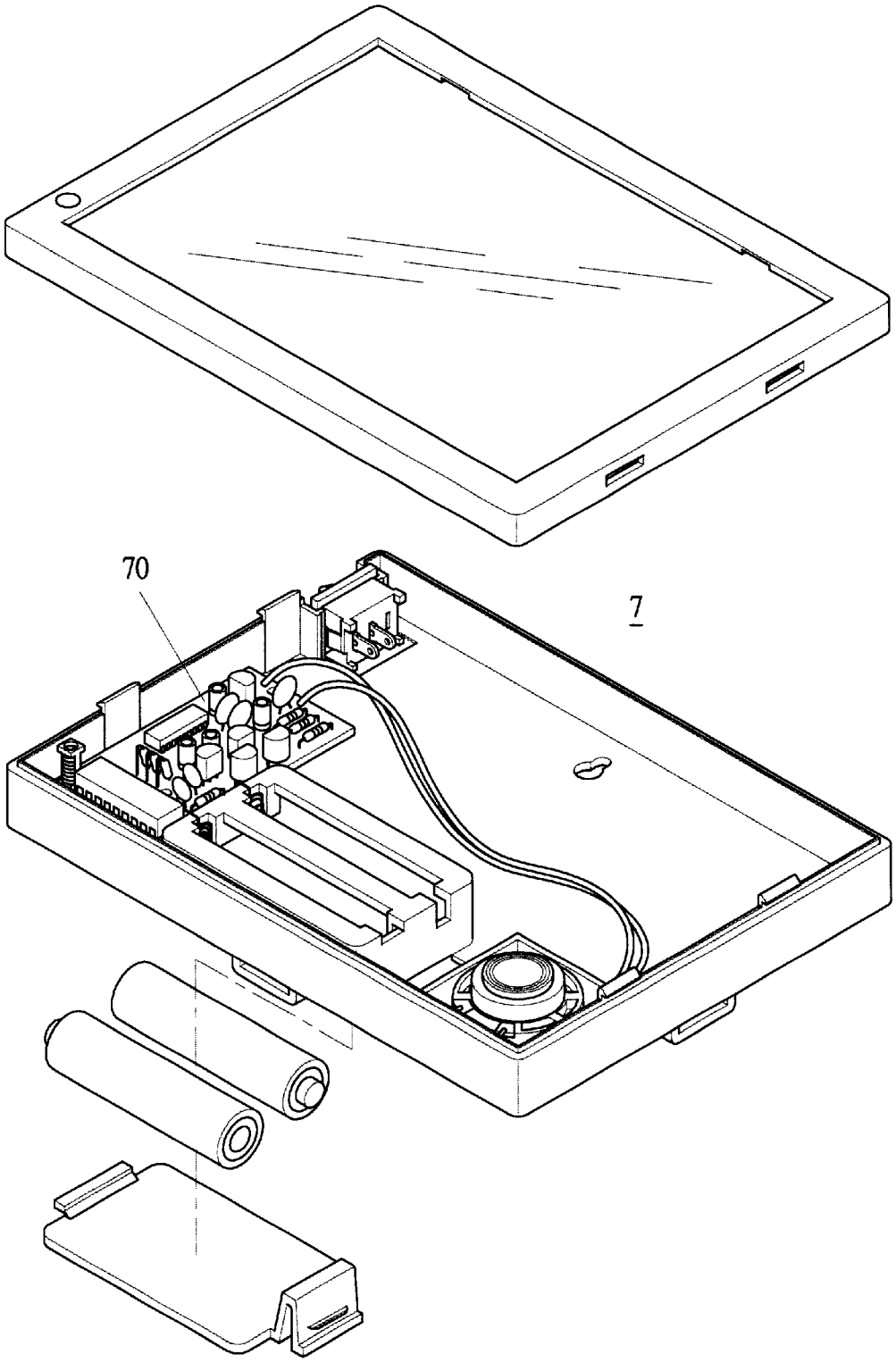
FIG. 13 is an exploded perspective view of a subsidiary device in the second embodiment of a picture frame in the present invention.

A subsidiary device 7, as shown in FIG. 13, can be additionally provided. The main body of the subsidiary device 7 has the same structure as that of the main body 1. The subsidiary device 7 is installed inside with a receive circuit 70 for receiving unusual signals coming from the emission circuit 42.

Figure 14:
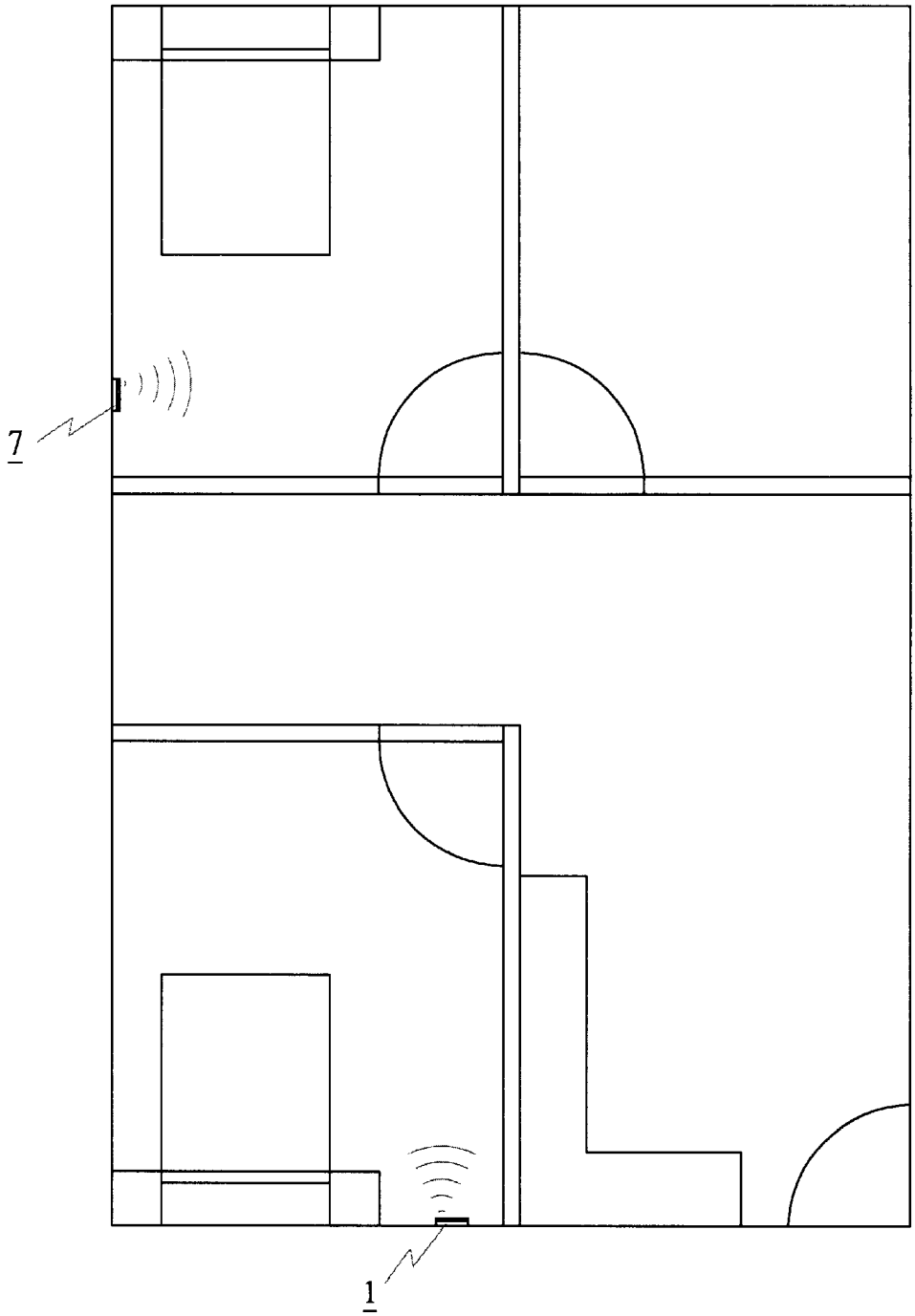
FIG. 14 is a front view of the second embodiment of a picture frame hung on a wall of different rooms in the present invention.
Figure 16:
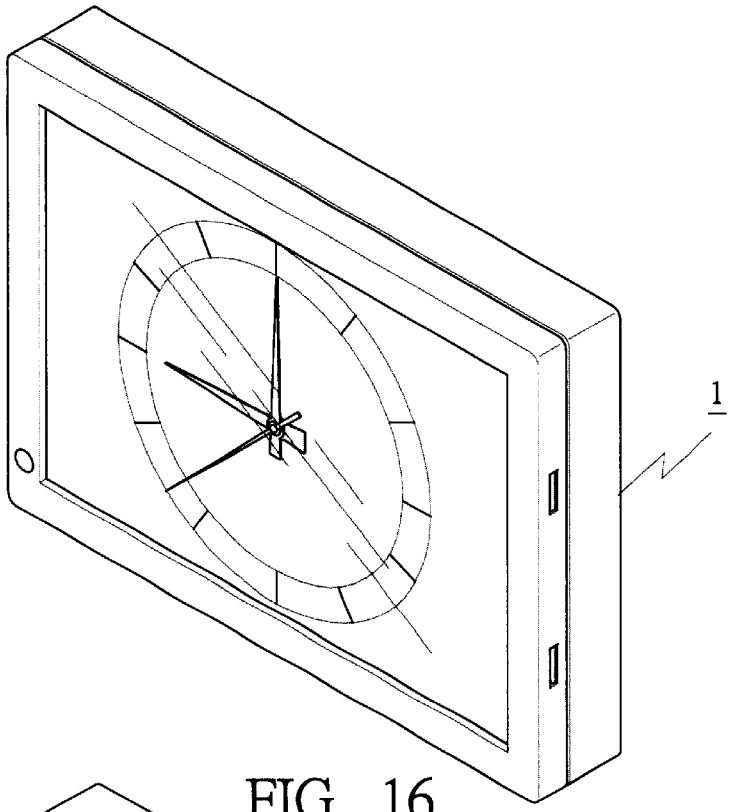
FIG. 16 is a perspective view of a clock provided with a fire warning device and an anti-burglary device in the present invention: and, FIG. 17 is a perspective view of a calendar provided with a fire warning device and an anti-burglary device in the present invention.
Figure 17:
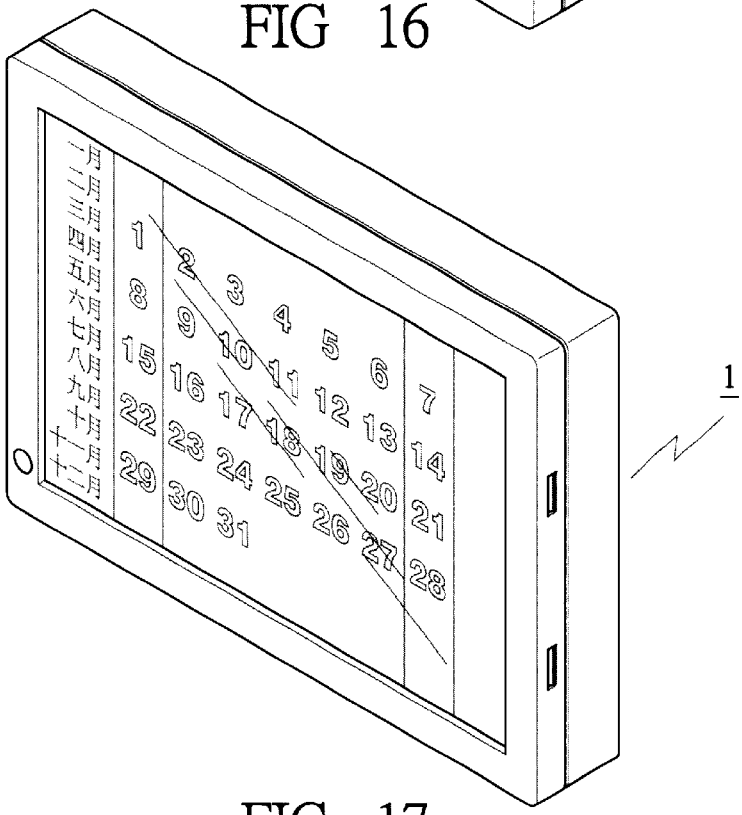

Thus, when the main and the subsidiary devices are respectively placed in different rooms or different stories, as shown in FIG. 14, the sensor 410 of the main device can sense any unusual light sources and actuate the speaker of the subsidiary device 7 to give out warning sounds. And at this time, the emission circuit 42 delivers signals to the receive circuit 70 to start the subsidiary device 7 to make its speaker give out warning sounds at the same time. Thus, the picture frame, the doorbell, the clock (shown in FIG. 16) or the calendar (shown in FIG. 17) has function of warning a danger in addition to as a decoration.

Figure 15:
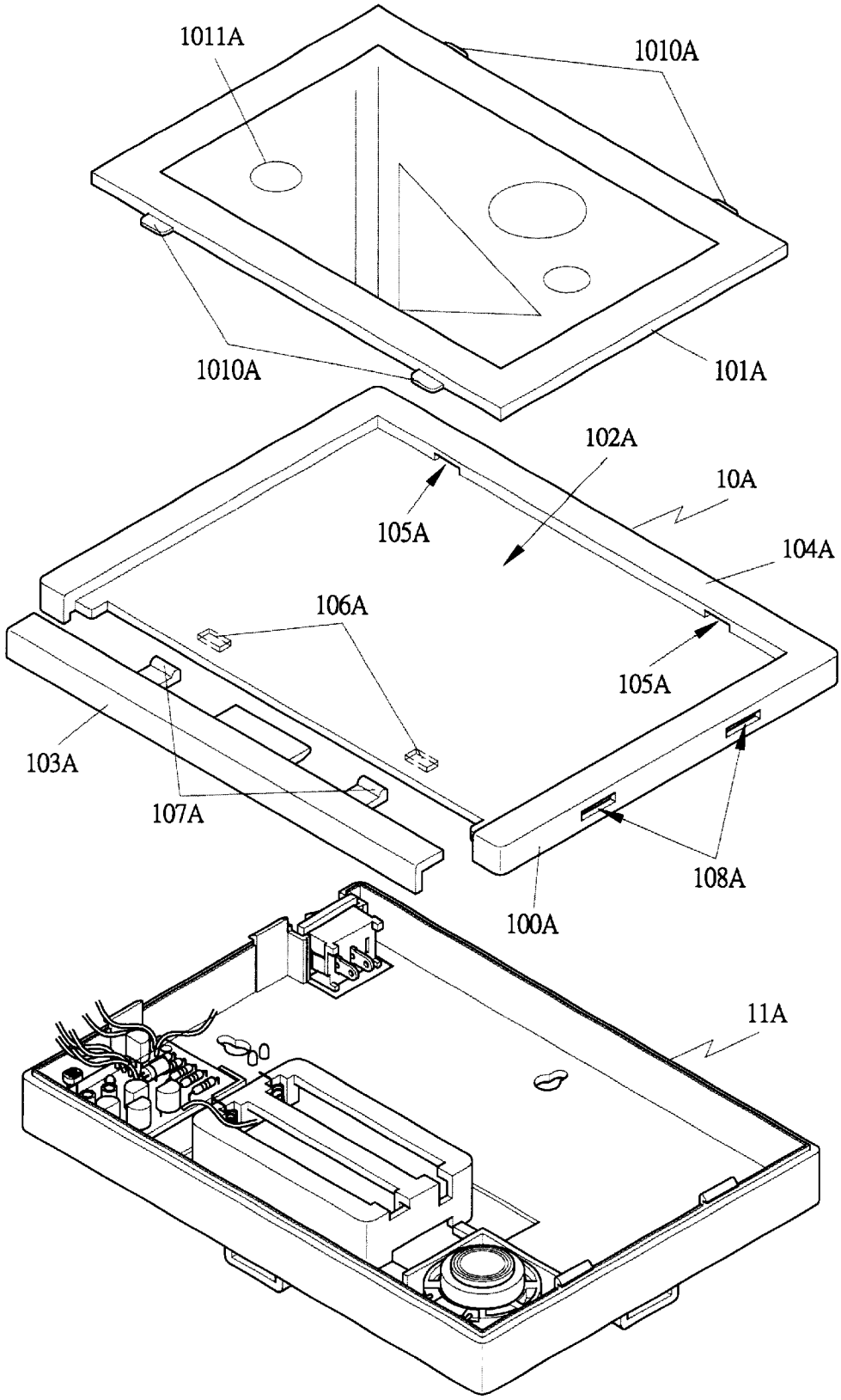
FIG. 15 is an exploded perspective view of a third embodiment of a picture frame in the present invention.

A third preferred embodiment of a picture frame or a doorbell having warning function in the present invention, as shown in FIG. 15, includes a main body composed of a front housing (10A) and a rear housing (11A), with the structure of the rear housing (11A) being the same as that in the first preferred embodiment.

But the front housing (10A) includes a circumferential wall (100A), a bottom plate and a decoration board (101A). The circumferential wall (100A) and the bottom plate define a recess (102A) and having a detachable sidewall (103A) at a lengthwise side, and the detachable sidewall (103A) and its opposite sidewall (104A) is respectively bored with two insert slots (105A) for receiving the decorative board (101A). Then, two mortises (106A) are bored in the bottom plate of the recess (102A) for two tenons (107) of the detachable frame wall (103A) to engage therein, combining the detachable sidewall (103A) with the bottom plate together. And only before their combination, the decorative board (101A) has to be fitted in the recess (102A) by inserting its insert projections (1010A) into the insert slots (105A) of the circumferential wall (100A) to let the decorative board (101A) and the circumferential wall (100A) combined together.

In addition, the decorative board (101A) can in advance be printed with colorful designs (1011A) to increase decorative effect, and two slots (108A) are respectively bored on opposite sides of the circumferential wall (100A) for the projections of the rear housing to engage therein.

To sum up, the main body of the main device in this invention can be modified in appearance, and the empty space of a picture frame or of a doorbell can be provided with a fire warning device and an anti-burglary device for practical use.

While the preferred embodiments of the invention have been described above, it will be recognized and understood that various modifications may be made therein and the appended claims are intended to cover all such modifications that may fall within the spirit and scope of the invention.

What is claimed is:

1. A picture frame or a doorbell having warning functions comprising:

a main body composed of a front housing and a rear housing, said front housing consisting of a circumferential wall, a bottom plate and a decorative board, said circumferential wall and said bottom plate defining a recess, said circumferential wall provided with insert slots in opposite sides and a sensor hole in one corner, a transparent plate fitting in said insert slots for placing photos or pictures, said bottom plate of said front housing bored with two mortises respectively for receiving tenons of said rear housing, said rear housing having said two tenons respectively formed integral on opposite circumferential walls, said tenons respectively engaging with said mortises to combine said rear housing with said front housing together, said rear housing further having hang holes bored on its bottom board for hanging said doorbell or said picture frame on a wall, said rear housing further having a combining slot respectively provided on two sides to combine with a base;

a speaker and an electronic control board installed in said rear housing, said speaker giving out warning sounds when said main control circuit receives any unusual signals or when the doorbell rings, said rear housing provided with a battery case for receiving batteries therein, said battery case covered up with a battery cover; and, said base having a flat member for said picture frame or said doorbell to stand on something, said base formed with a circumferential wall standing up on said flat member for resting against a bottom side of said main body, said base provided at a rear portion with an engage base having a clamp slot for engaging said combining slot of said rear housing to let said main body and said base combined together.

2. A picture frame or doorbell having warning functions comprising:

a main body composed of a front housing and a rear housing, said front housing having a circumferential wall, a bottom plate and a decorative plate, said circumferential wall defining a recess and having insert slots and a senor hole, a transparent plate fitting in said insert holes, said front housing having two mortises in opposite sides for combining said rear housing;

a rear housing formed integral with two tenons respectively on opposite circumferential sidewalls, said tenons respectively engaging with said mortises of said front housing to combine said rear housing with said front housing together, said rear housing having hang holes on its bottom board for hanging said doorbell or said picture frame on a wall, said rear housing having a combining slot respectively provided on two sides to be combined with a base;

a speaker and an electronic control board installed in said rear housing, said electronic control board having a main control circuit and/or an emission circuit, said main control circuit provided with a sensor, said sensor receiving unusual signals, said speaker giving out warning sounds when said main control circuit receives any unusual signals or when said doorbell rings, said rear housing provided with a battery case for receiving batteries therein, a battery cover closing on said battery case; and, a subsidiary device provided inside with a receive circuit and a speaker, said sensor of said main control circuit sensing smoke and said main control circuit actuating said speaker to give out warning sounds when there is smoke or fire or when someone breaks in illegally, said emission circuit of said main control circuit delivering signals to said receive circuit of said subsidiary device, said speaker of said subsidiary device giving out warning sounds at the same time.

3. The picture frame or the doorbell having warning functions as claimed in claim 1, wherein said circumferential wall of said front housing consists of two lateral sidewalls, one stationary lengthwise sidewall and a detachable lengthwise sidewall, said detachable lengthwise sidewall having two tenons to engage two mortises provided in said bottom plate to secure said detachable sidewall with said bottom plate, said detachable sidewall and its opposite sidewall respectively bored with two insert slots, said decorative plate fitted in said recess before combining said detachable sidewall with said bottom plate, said decorative plate having its insert projections engaging said insert slots of said circumferential wall to combine them together, said circumferential wall of said front housing bored with mortises in opposite sidewalls to be combined with said rear housing.

* * * * *